United States Patent [19]

Knight et al.

[11] 4,353,542

[45] Oct. 12, 1982

[54] SHEET COLLECTION APPARATUS AND SORTERS INCORPORATING SAME

[75] Inventors: Clifford Knight, Newnham; William Gilmour, Gloucester; Bernard F. Page, Coleford; John Bilton, Stroud, all of England

[73] Assignee: Xerox Corporation, Stamford, Conn.

[21] Appl. No.: 172,497

[22] Filed: Jul. 25, 1980

[30] Foreign Application Priority Data

Jul. 27, 1979 [GB] United Kingdom ..... 7926266

[51] Int. Cl.[3] ..... B65H 39/11

[52] U.S. Cl. ..... 271/294; 271/209; 271/212

[58] Field of Search ..... 271/212, 209, 294, 293, 271/292, 295, 287, 180, 181, 296, 297; 414/95, 96, 92, 93, 94; 270/58

[56] References Cited

U.S. PATENT DOCUMENTS

| | | | |
|---|---|---|---|
| 2,224,606 | 12/1940 | Neckel | 271/212 |
| 2,426,957 | 9/1947 | Trump | 271/209 |
| 2,488,675 | 11/1949 | Malott | 271/212 X |
| 2,595,346 | 5/1952 | Federwitz | 271/212 X |
| 3,212,774 | 10/1965 | Ingalls | 271/212 |
| 3,396,966 | 8/1968 | Solheim | 271/212 |
| 3,692,304 | 9/1972 | De Ridder | 271/212 |
| 3,744,649 | 7/1973 | Ward | 271/212 X |
| 3,938,802 | 2/1976 | Hartman | 271/294 X |
| 3,971,554 | 7/1976 | Stange | 271/212 X |
| 4,026,540 | 5/1977 | Lawrence | 271/287 |
| 4,068,767 | 1/1978 | Tippetts | 271/212 X |
| 4,068,837 | 1/1978 | Lamos | 271/296 |
| 4,111,410 | 9/1978 | Tates et al. | 271/288 X |
| 4,190,354 | 2/1980 | Smith et al. | 271/212 X |
| 4,266,761 | 5/1981 | Buck | 270/58 |

*Primary Examiner*—Bruce H. Stoner, Jr.
*Attorney, Agent, or Firm*—Bernard A. Chiama

[57] ABSTRACT

A sheet collection apparatus for stacking sheets delivered thereto face-up in the order 1 to n with sheet 1 on the top of the stack. The apparatus includes one or more collection trays, such as the bins of a sorter which are indexed past a feed throat. Retractable support arms at the throat support the sheets already in a bin opposite the throat during delivery of a sheet thereto whereby the sheet enters the bin below the support arms.

5 Claims, 6 Drawing Figures

SHEET COLLECTION APPARATUS AND SORTERS INCORPORATING SAME

This invention relates to apparatus for collecting in a stack sheets delivered serially thereto face-up. By face-up is meant in relation to a simplex sheet that the printed side of the sheet is upwards and in relation to a duplex sheet that the odd-numbered side is upwards.

The problem which occurs when sheets exit in number order from a processor such as a document copier or printer face-up is that they become stacked in reverse number order so that for a set of sheets 1 to n, sheet n is on the top of the stack with sheet 1 at the bottom which is inconvenient for the user. In order to overcome this problem, copiers of the kind in which the sheets are delivered from the processor in face-up condition have included a sheet inverter. Examples of this are to be found in U.S. Pat. Nos. 3,833,911, 3,917,257, 3,977,667 and 4,111,410 in which it will be seen that the sheets are turned over by the inverter so that they are delivered into the copy bins face-down. In the absence of an inverter sheets delivered to a collection tray in the order 1 to n are stacked with sheet n at the top as shown for example in U.S. Pat. No. 3,938,802.

According to the present invention, there is provided, from one aspect, sheet collection apparatus including a tray for collecting in a stack sheets delivered serially thereto face-up, in which between the delivery of successive sheets the sheet or stack of sheets in the tray is raised above the tray support surface whereby the next sheet is delivered into the tray therebeneath.

From another aspect, there is provided a sorter comprising an array of bins, a feed throat for delivering sheets to the bins, and means for indexing the bins past the feed throat to receive sheets in turn, characterised by retractable support means at the throat for supporting any sheets in a bin opposite the throat during delivery of a sheet thereto whereby the sheet enters the bin below the support means.

By means of the invention sheets delivered to a collection tray in number order face-up are stacked in order.

In order that the invention may be more readily understood, reference will now be made to the accompanying drawings, in which.

Figure 1:
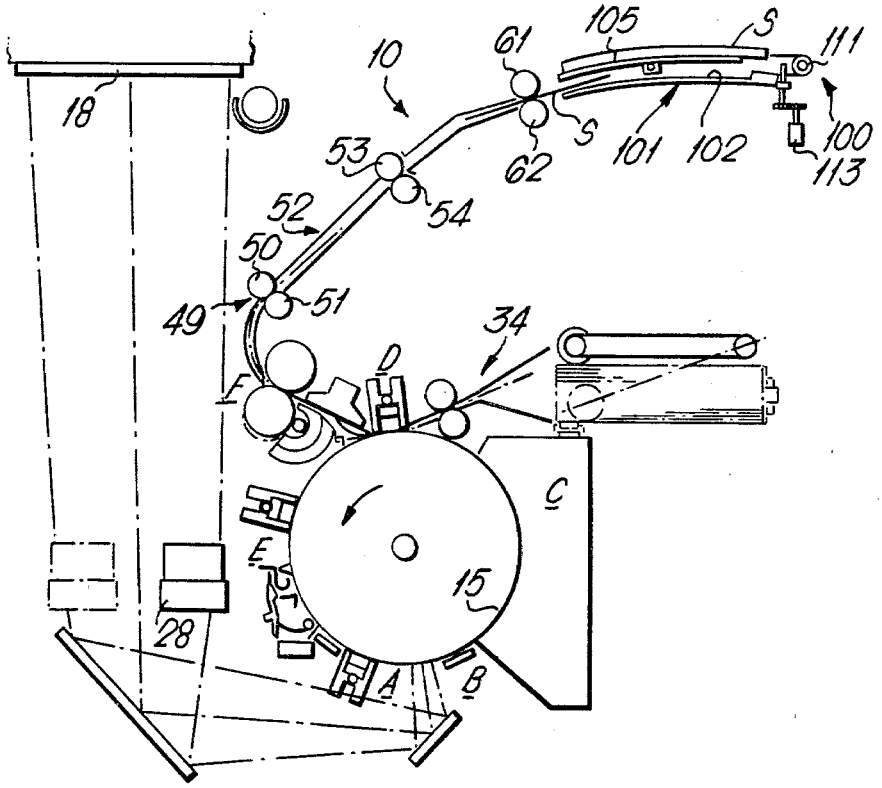
FIG. 1 shows a xerographic copier incorporating a sheet collection apparatus according to the invention.

Referring to FIG. 1 there is shown an automatic xerographic reproducing machine 10 having a sheet collection apparatus 100 according to this invention for collecting copy sheets produced in the machine 10. Although the present invention is particularly well suited for use in automatic xerography, the apparatus 100 is equally well adapted for use with any number of devices in which cut sheets of material are delivered or compiled in a set or stack.

The processor 10 includes a photosensitive drum 15 which is rotated in the direction indicated so as to pass sequentially through a series of xerographic processing stations: a charging station A, an imaging station B, a developer station C, a transfer station D and a cleaning station E.

A document to be reproduced is placed on a platen 18 and scanned by means of a moving optical scanning system including lens 28 to produce a flowing light image on the drum at B. Cut sheets of paper are moved into the transfer station D from sheet registering apparatus 34 in synchronous relation with the image on the drum surface. The copy sheet is stripped from the drum surface and directed to a fusing station F. Upon leaving the fuser, the fixed copy sheet is passed through a curvilinear sheet guide system, generally referred to as 49, incorporating advancing rolls 50 and 51. The advancing rolls forward the sheet through a linear sheet guide system 52 and to a second pair of advancing rollers 53 and 54. From here copy sheet is forwarded to the sheet collection apparatus 100 via pinch rolls 61, 62. As will be apparent from a study of FIG. 1, the copy sheets S are delivered to the apparatus 100 face-up.

Figure 2:
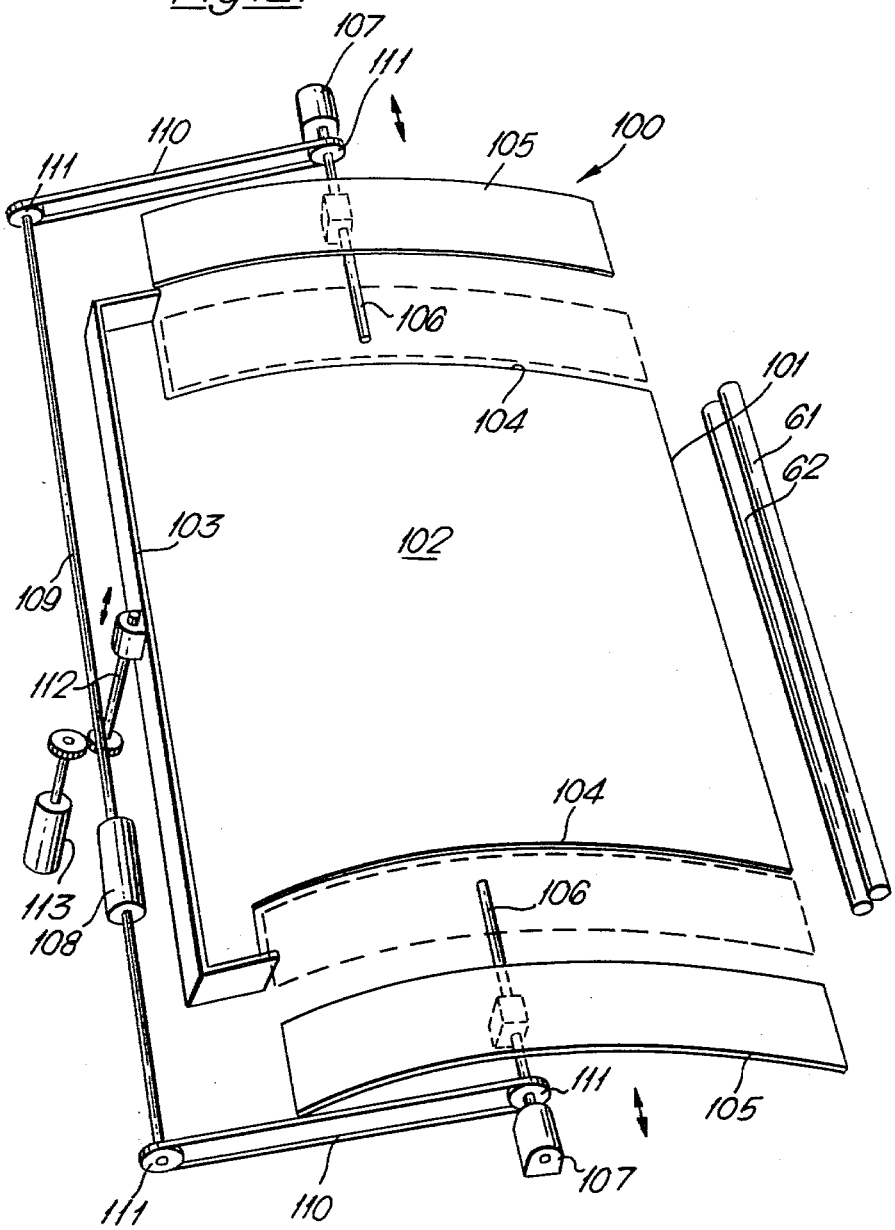
FIG. 2 is a perspective view of the sheet collection apparatus showing greater detail.

The sheet collection apparatus 100 comprises a tray 101 into which sheets are delivered serially via the nip rolls 61, 62. The tray has a support surface 102 which extends in a convex curve between its input end and an end wall 103 at the far end of the tray. The tray has cut-outs 104 extending for nearly its full length along each side. Retractable bail bars 105, curved to match the profile of the surface 102, are dimensioned to fit into the cut-outs. The bail bars are movable between the positions shown in dotted lines in FIG. 2 in which they form part of the tray support surface 102 and the retracted positions shown in full lines. The tray 101 is movable vertically between an upper position aligned with the bail bars 105 (FIG. 2) and a lower position below the bail bars in which it is aligned with the nip rollers 61, 62 (FIG. 1).

The bail bars 105 are mounted on horizontal lead screws 106 supported in bearings 107. The lead screws 106 are driven from a motor 108 via shaft 109 and belts 110 entrained over pulleys 111. The tray 101 is mounted on a vertical lead screw 112 and driven from a motor 113.

Copy sheets are delivered serially to the tray 101 face-up and the apparatus illustrated ensures that sheets arriving in ascending page-number order are stacked in ascending order in the tray. This is achieved in the following manner. For receiving a sheet, the bail bars are advanced to their dotted line positions in the cut-outs 104 in line with the surface 102, by activating motor 108. The motor 113 is then activated to lower the tray 101 by rotating lead screw 112. The bail bars which are positioned beneath the opposite side edges of any sheets already stacked in the tray, support the sheets as the tray is lowered, the curved form of the bail bars serving to increase the beam strength of the stacked sheets and ensure that they do not bend laterally. With the tray lowered the next sheet is advanced into the tray through the nip rollers 61, 62. The tray is then raised and the bail bars retracted to their full-line positions. The new sheet is now correctly positioned at the bottom of the stack and the process is repeated for each sheet feed into the tray.

Figure 3:
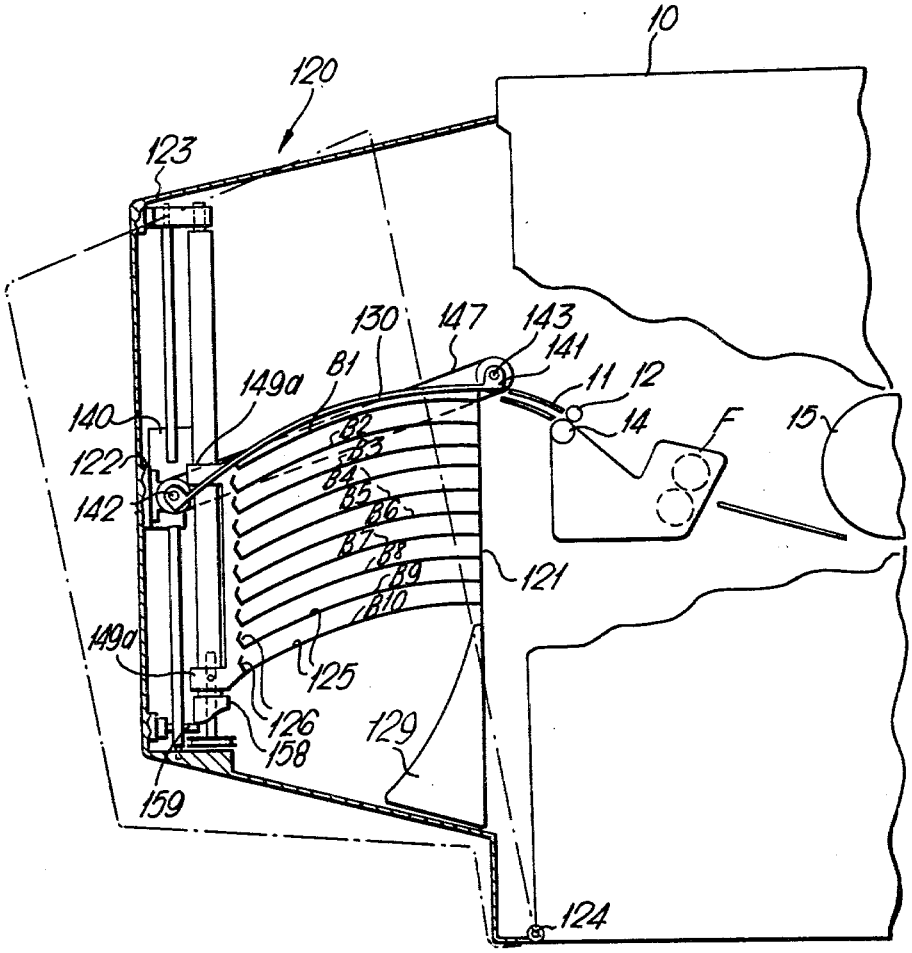
FIG. 3 is a side elevation of a copier incorporating a sorter according to the invention.
Figure 4:
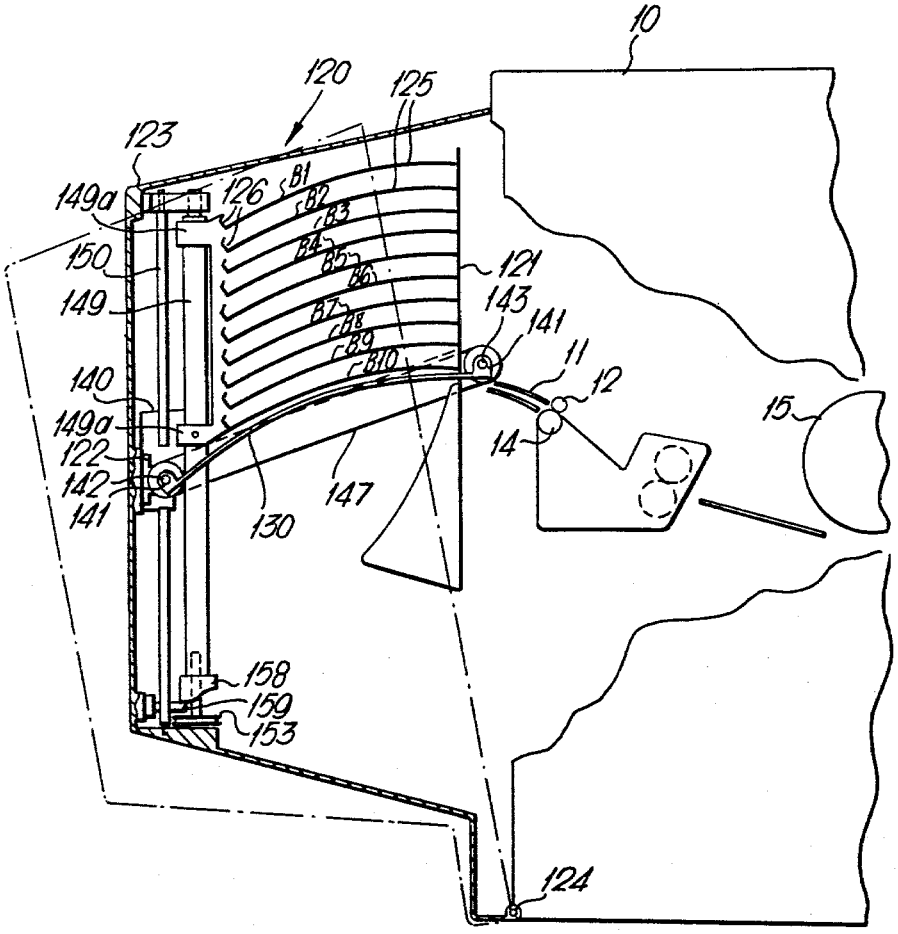
FIG. 4 is a view like that of FIG. 3 but with the sorter in a different operational condition.

Turning now to FIGS. 3 to 6, there is illustrated a sorter 120 according to the invention. As seen in FIG. 3, the sorter is attached to the output end of a photocopier 10 from which sheets are serially delivered through exit slot 11 by means of exit nip rollers 12, 14. The sorter has ten bins B1–B10 which are arranged to be indexed past the exit slot 11 of the copier so that successive sheets may be received in respective bins. The bins B together with the sorter mechanism are mounted on a frame 122 and are enclosed by a cover 123. The whole sorter assembly is hingedly connected to the copier at 124 so that it may be swung away as illustrated in outline in FIGS. 3 and 4 to obtain access to the sorter. The front side of the sorter, i.e. the side facing the viewer in FIG. 3, is open for access to the bins for removal of the sheets collected therein.

The bins B comprise support surfaces 125 which extend in a convex curve, best seen in FIG. 3, between their input ends adjacent the exit slot 11 and end walls 126 at their opposite ends. A guide plate 127 overlies the far end of the uppermost bin. The bins are mounted as a unit 121 for vertical movement between a lowermost position as shown in FIG. 3 and an uppermost position shown in FIG. 4. In the latter position the lowermost bin is positioned slightly above the exit slot 11 and sheets may be delivered into a catch tray below the array 121 of bins. This tray which is particularly suitable for sheets which are too wide to be received in the bins has a guide surface 129 which moves with the bin unit 121.

Figure 5:
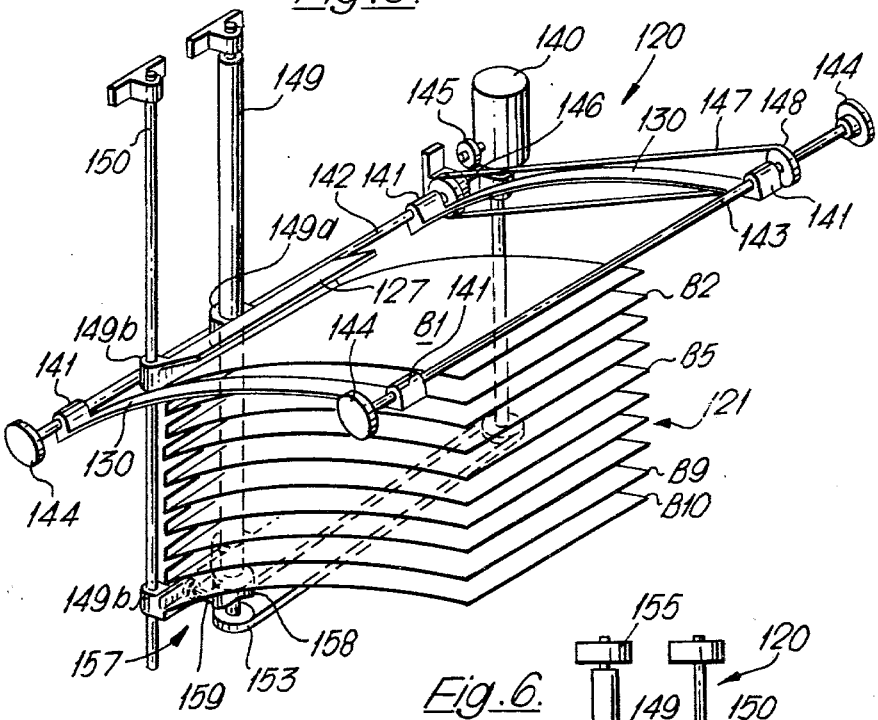
FIG. 5 is a perspective view of the sorter illustrating the sorter mechanism.
Figure 6:
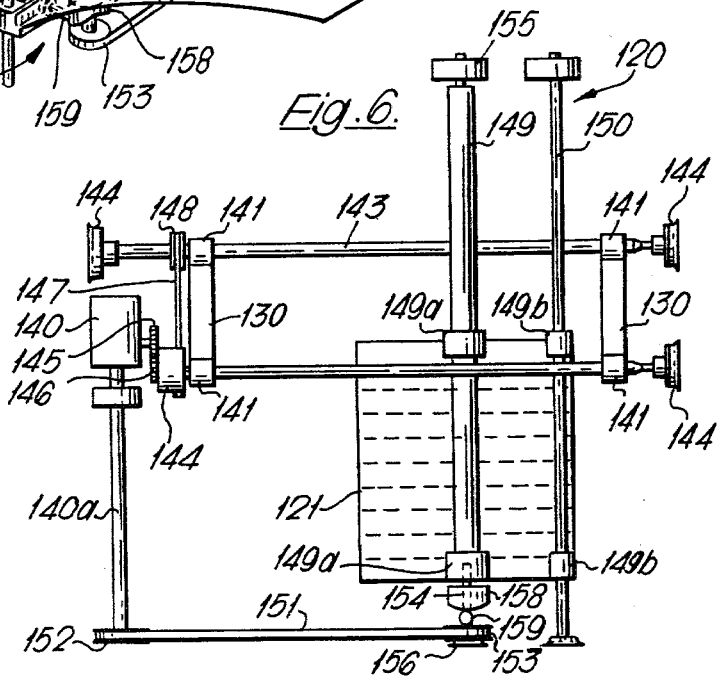
FIG. 6 is an end view of the sorter taken from the left hand end of FIG. 3.

A pair of bail bars 130, profiled to match the curvature of the bins 121, are arranged at opposite sides of the bin unit 121 as seen in FIGS. 5 and 6. The bail bars are vertically fixed but movable laterally of the bins between an outer position spaced from the bins as shown in the drawings and an inner position alongside the bins. In their outer positions the bail bars are spaced apart by a distance which is greater than the length of the largest sheet of paper which can be received in the bins. In the embodiment illustrated in FIGS. 1 and 2 the sheets are centre-registered so that different-sized sheets have the same centre-line and the bail bars are symmetrically arranged. In this embodiment the sheets exit from the copier registered with respect to one edge and in order to accommodate varying sizes of edge-registered sheets, the bail bars are asymmetrically arranged in their outer positions. In their inner positions they are symmetrically arranged next to the bins, so that the rear bail bar moves further between its inner and outer positions than the front bail bar.

In operation the bins may be indexed past the exit slot 11 upwardly or downwardly. At the start of a bin loading cycle, the bail bars are moved to their outer positions. The bin unit is driven upwardly until the top bin B1 is above the bail arms which are then moved inwardly below the edges of any sheets already in the bin. The bin unit is then moved downwardly into register with the exit slot 11, leaving the sheets supported on the bail arms. A sheet is now ejected through slot 11 by nip rollers 12, 14 into the bin B1, face-up, following which the bail arms are moved outwards allowing the sheets thereon to fall on to the sheet just delivered. The bin unit is now driven upwardly until bin B2 is above the bail arms and the bail arms are returned to their inner positions; as the bin unit is indexed down to bring bin B2 into alignment with slot 11, the sheets in that bin are supported by the bail bars. Following sheet delivery the bail bars are retracted as before to compile the B2 sheets and the process is repeated for bin B3, etc.

For upward indexing, bin B10 is raised above the bail bars, the latter being in their outer positions, and then lowered into alignment with the exit slot 11, the bail bars supporting sheets already in bin B10. After a sheet has been delivered into bin B10, it is raised and simultaneously the bail bars are retracted so that the sheets are compiled in bin B10. Lifting of the bin unit is continued until bin B9 is just above the bail bars. The loading sequence is now repeated for bin B9 and again for the other bins.

It should be noted that the sorter may be programmed to sort sheets into sets of less than ten in which case it will index past only the appropriate number of bins. It may be arranged to operate unidirectionally being returned in a single movement to its start position at the end of each indexing pass or it may be arranged to operate bidirectionally, indexing past the exit slot in both upwardly and downwardly.

The sorter may be programmed so that it will also operate in non-sort mode in which successive sheets are delivered to the same bin, e.g. B10.

The mechanism by which the bail bars are moved laterally and the bins are indexed vertically will now be described. They are driven from a common motor 140. The bail bars are carried by screw blocks 141 mounted on a pair of horizontal lead screws 142, 143 supported in bearings 144. The lead screw 142 is driven off motor 140 via gears 145, 146 and the lead screw 143 is driven from the screw 142 via a timing belt 147 entrained over pulleys 148. Because of the asymmetrical movement of the bail bars described above, the pitches of the lead screws 142, 143 are different at each end so that the rear bail bar moves faster than the front bail bar.

The bin unit is mounted by means of screw blocks 149*a* on a vertical lead screw 149 and stabilised by side blocks 149*b* running on a stabiliser bar 150. The lead screw 149 is driven off the drive shaft 140*a* of motor 140 through a timing belt 151 entrained over pulleys 152, 153. The lead-screw 149 is splined to a drive shaft 154 to which the pulley 153 is fixed. The assembly is rotatably mounted in bearings 155, 156 and the splined connection between the shaft 154 and the lead-screw 149 allows the latter to slide vertically on the drive shaft while being rotatable with the drive shaft. The bin assembly 121 is indexed by a camming mechanism 157 which includes a face cam 158 fixed on the bottom end of the lead-screw 149 and a cam follower 159 fixed to the sorter frame 122.

The pitch of lead-screw 149 is equal to the spacing between adjacent bins (bin pitch) so that a single revolution of the lead screw performs an indexing movement of the bin unit or array.

The cam 158 is profiled for indexing of the bin array by continuous rotation of the drive shaft 154. One revolution of the drive shaft causes the bin unit to rise one and a half bin pitches and then fall half a pitch in one cycle. The rise and fall of the bin array is timed in order to allow the bail bars to achieve their correct position to support the existing sheets in the relevant bin. Thus the cam first raises the bin above the bail bars and then lowers it into alignment with the exit slot 11, the bail bars supporting the sheets already in the bin. A dwell time corresponding to the time taken for delivery of the sheet into the bin completes the revolution and the cam again raises the bin array by one and a half bin pitches to commence the next indexing pass.

When the required number of bins, depending upon the number of sheets in the set being sorted, has been indexed past the slot the motor 140 is reversed to drive the bin array back to its lowered position ready for another indexing cycle.

It will be noted that with a sheet collection apparatus according to the invention, each sheet enters an empty bin so that the friction characteristics for sheet delivery remain the same regardless of how many sheets have already been delivered.

While particular embodiments of the invention have been described, it will be realised that various modifications may be made without departing from the scope of the invention as defined in the appended claims. For example, although the arrangement described above will index only upwardly, it will be understood that other arrangements will index downwardly or in both directions. For indexing downwardly using a continuously rotating lead screw 148, a cam 158 is required which for each bin lowers the bin array half a pitch, dwells for loading the bin and then lowers the array a further half pitch. For indexing in both directions, both types of cam may be provided, pawls serving to activate only one cam at a time depending upon the direction of rotation of the lead screw.

What is claimed is:

1. In a sorter comprising a generally-vertically arranged array of bins, a feed throat for delivering sheets to the bins, and means for vertically indexing the bins past the feed throat to receive sheets in turn, the improvement comprising retractable support means at the throat for supporting any sheets in a said bin opposite the throat during delivery of a sheet thereto whereby the sheet enters the bin below the support means.

2. In a sorter comprising an array of bins, a feed throat for delivering sheets to the bins, and means for indexing the bins past the feed throat to receive sheets in turn, the improvement comprising retractable support means at the throat for supporting any sheets in a said bin opposite the throat during delivery of a sheet thereto whereby the sheet enters the bin below the support means, said bins and said retractable support means have support surfaces which each define a convex curve in the direction of sheet travel.

3. In a sorter comprising an array of bins, a feed throat for delivering sheets to the bins, and means for indexing the bins past the feed throat to receive sheets in turn, the improvement comprising retractable support means at the throat for supporting any sheets in a said bin opposite the throat during delivery of a sheet thereto whereby the sheet enters the bin below the support means, said retractable support means comprises a pair of arms movable between sheet supporting positions at opposite sides of a bin and retracted positions spaced laterally of the bin array.

4. A sorter according to claim 3 in which in their retracted positions one support arm is disposed further from the bin array than the other.

5. In a sorter comprising an array of bins, a feed throat for delivering sheets to the bins, and means for indexing the bins past the feed throat to receive sheets in turn, the improvement comprising retractable support means at the throat for supporting any sheets in a said bin opposite the throat during delivery of a sheet thereto whereby the sheet enters the bin below the support means, said bin array being indexed upwardly past the feed throat, the bins in turn being raised above the retracted support means, and following insertion of the support means lowered into alignment with the feed throat ready to receive a sheet through the feed throat.

* * * * *